US005877796A

United States Patent [19]

Tsuchiya et al.

[11] Patent Number: 5,877,796

[45] **Date of Patent: *Mar. 2, 1999**

[54] RECORDING SHEET FOR INK-JET RECORDING AND RECORDING METHOD EMPLOYING THE SAME

[75] Inventors: Ichiro Tsuchiya; Noriaki Kurata; Hiroyuki Uemura, all of Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 639,766

[22] Filed: Apr. 29, 1996

[30] Foreign Application Priority Data

May 12, 1995 [JP] Japan ..... 7-114601

[51] Int. Cl.[6] ..... B41M 5/00

[52] U.S. Cl. ..... 347/105; 347/101

[58] Field of Search ..... 347/105, 101

[56] References Cited

U.S. PATENT DOCUMENTS

| | | | |
|---|---|---|---|
| 4,503,111 | 3/1985 | Jaeger et al. | 428/195 |
| 4,781,985 | 11/1988 | Desjarlais | 428/421 |
| 4,946,741 | 8/1990 | Aono et al. | 428/336 |
| 4,954,395 | 9/1990 | Hasegawa et al. | 428/318.4 |
| 5,271,989 | 12/1993 | Mori et al. | 428/195 |
| 5,643,380 | 7/1997 | Saitoh et al. | 156/94 |

FOREIGN PATENT DOCUMENTS

| | | |
|---|---|---|
| 261505 | 3/1988 | European Pat. Off. . |
| 252779 | 10/1988 | Japan . |
| 146784 | 6/1989 | Japan . |
| 146785 | 6/1989 | Japan . |

OTHER PUBLICATIONS

Grant and Hackh's Chemical Dictionary; Roger Grant and Claire Grant; McGraw–Hill Book Company; p. 36, 1987.

*Primary Examiner*—Valerie Lund
*Assistant Examiner*—Christina Annick
*Attorney, Agent, or Firm*—Jordan B. Bierman; Bierman, Muserlian and Lucas

[57] ABSTRACT

An ink-jet recording method is disclosed, which comprises the step of jetting a water-based ink on a recording sheet, the recording sheet comprising a support and provided thereon, an ink receiving layer containing a binder, an anionic fluorine-containing surfactant and a cationic fluorine-containing surfactant, wherein the content ratio of the anionic fluorine-containing surfactant to the cationic fluorine-containing surfactant is 1:10 to 10:1 in terms of mole ratio.

11 Claims, No Drawings

RECORDING SHEET FOR INK-JET RECORDING AND RECORDING METHOD EMPLOYING THE SAME

FIELD OF THE INVENTION

The present invention relates to a recording sheet for ink-jet recording and a recording method for ink-jet recording, and particularly to a recording sheet for ink-jet recording and a recording method for ink-jet recording in which a water based ink is used.

BACKGROUND OF THE INVENTION

Recently, following the proliferation of personal computers, ink-jet recording system printers are rapidly spreading. Specifically, in the field of graphic art and designing, its utilization is being taken notice of due to its high quality resembling photography.

As a recording sheet used for ink-jet recording system, conventionally, a recording sheet wherein an ink receiving layer (hereinafter, referred also to as "ink-absorption layer") is provided on ordinary paper or a support referred to as an ink-jet recording paper has been used. However, when the above-mentioned recording papers are employed, much ink blurring results and glossiness is low. Therefore, the above-mentioned recording papers could not be employed for the above-mentioned field wherein high resolution and high glossiness is required.

In addition, when a transparent support is used to produce an original for an OHP (over-head projector), there was the problem that a porous ink-absorption layer interferred light transmittance.

In order to overcome the above-mentioned problems, Japanese Patent Publication Open to Public Inspection (hereinafter, referred to as Japanese Patent O.P.I. Publication) Nos. 216990/1992 and 64306/1994 disclose technologies of an ink-jet recording sheet wherein a resin-covered paper, i.e., an RC (resin coated) paper, in which both sides of the paper are covered with resin, is used for a support and gelatin is used for the ink-receiving layer.

According to the above-mentioned specifications, they assured to have high resolution and, further, could provide a glosy image. However, they were still inadequate in terms of overall quality. Specifically, dot reproducibility was insufficient so that they could not be used for original graphic art work nor printing of a fine design picture.

SUMMARY OF THE INVENTION

An objective of the present invention is to provide a recording sheet for ink-jet recording capable of obtaining high image quality and stable image quality in ink-jet recording, and to provide a recording method employing aforesaid sheet for ink-jet recording.

DETAILED DESCRIPTION OF THE INVENTION

The above objects of the invention can be attained by the following:

1. A recording sheet for ink-jet recording comprising a support, and provided thereon, an ink receiving layer, wherein the ink receiving layer contains an anionic fluorine-containing surfactant and a cationic fluorine-containing surfactant.

2. The recording sheet for ink-jet recording of 1 above, wherein the content ratio of the anionic fluorine-containing surfactant to the cationic fluorine-containing surfactant is 1:10 to 10:1 in terms of mole ratio.

3. The recording sheet for ink-jet recording of 1 or 2 above, wherein the content ratio of the anionic fluorine-containing surfactant to the cationic fluorine-containing surfactant is 3:7 to 7:3 in terms of mole ratio.

4. The recording sheet for ink-jet recording of 1, 2 or 3 above, wherein the ink receiving layer further contains gelatin.

5. The recording sheet for ink-jet recording of 1, 2, 3 or 4 above, wherein the ink receiving layer further contains gelatin and a water-soluble polymer.

6. The recording sheet for ink-jet recording of 1, 2, 3, 4 or 5 above, wherein the water-soluble polymer is at least one compound selected from polyvinyl pyrrolidones and polyvinyl alcohols.

7. The recording sheet for ink-jet recording of 1, 2, 3, 4, 5 or 6 above, wherein the content ratio of the water-soluble polymer to the gelatin is 10 to 70 weight %.

8. The recording sheet for ink-jet recording of 1, 2, 3, 4, 5, 6 or 7 above, wherein the content ratio of the water-soluble polymer to the gelatin is 40 to 60 weight %.

9. The recording sheet for ink-jet recording of 1, 2, 3, 4, 5, 6, 7 or 8 above, wherein the support is a resin-covered paper, in which both surfaces of the paper are covered with a resin, or a polyester film.

10. The recording sheet for ink-jet recording of 9 above, wherein the resin is a polyolefin resin.

11. The recording sheet for ink-jet recording of 9 above, wherein the polyester is polyethylene terephthalate.

12. A method for ink-jet recording, the method employing a recording sheet for ink-jet recording comprising an ink receiving layer provided on a support, wherein the ink receiving layer contains an anionic fluorine-containing surfactant and a cationic fluorine-containing surfactant.

13. The method for ink-jet recording of 12 above, wherein the content ratio of the anionic fluorine-containing surfactant to the cationic fluorine-containing surfactant is 1:10 to 10:1 in terms of mole ratio.

14. The method for ink-jet recording of 12 or 13 above, wherein the content ratio of the anionic fluorine-containing surfactant to the cationic fluorine-containing surfactant is 3:7 to 7:3 in terms of mole ratio.

15. The method for ink-jet recording of 12, 13 or 14 above, wherein the ink receiving layer further contains gelatin.

16. The method for ink-jet recording of claim 12, 13, 14 or 15 above, wherein the ink receiving layer further contains gelatin and a water-soluble polymer.

17. The method for ink-jet recording of 12, 13, 14, 15 or 16 above, wherein the water-soluble polymer is at least one compound selected from polyvinyl pyrrolidones and polyvinyl alcohols.

18. The method for ink-jet recording of 12, 13, 14, 15, 16 or 17 above, wherein the content ratio of the water-soluble polymer to the gelatin is 10 to 70 weight %.

19. The method for ink-jet recording of 12, 13, 14, 15, 16, 17 or 18 above, wherein the content ratio of the water-soluble polymer to the gelatin is 40 to 60 weight %.

20. The method for ink-jet recording of 12, 13, 14, 15, 16, 17, 18 or 19 above, wherein the support is a resin covered paper, in which both surfaces of the paper are covered with a resin, or a polyester film.

21. The method for ink-jet recording of 20 above, wherein the resin is a polyolefin resin.

22. The method for ink-jet recording of 20 above, wherein the polyester is polyethylene terephthalate.

The present invention will be detailed below.

The recording sheet for ink-jet recording in the invention is characterized in that the ink receiving layer, contains the above described anionic fluorine-containing surfactant and cationic fluorine-containing surfactant.

It has been so far considered that a combination use of an anionic surfactant and a cationic surfactant causes undesirable coagulation in a coating solution prior to coating. However, the experimantal results by the present inventors have showed that a fluorine-containing surfactant does not cause coagulation in solution condition. In addition, when the fluorine-containing surfactant is used for recording sheets for ink-jet recording, excellent ink-receivability results and a phenomenon, wherein ink spot is difficult to diffuse over the passage of time, scarecely occurs. Therefore, larger ink spots can be utilized so that it has been found that an image with high density and small unevenness could be obtained.

As an anionic fluorine-containing surfactant preferably used in the present invention, those represented by the following Formula (FA) are cited.

Formula $$(FA)(Cf)—(Y)_n$$

wherein Cf represents an n-valent group containing at least 3 fluorine atoms and at least 2 carbon atoms; Y represents a —COOM, —$SO_3M$, —$OSO_3M$ or —$P(=O)(OM)_2$; M represents a hydrogen atom, an alkali metal or a cation such as a quaternary ammonium salt; and n represents 1 or 2.

The example of Cf includes an alkyl or alkenyl group having 2–30 carbon atoms and an aryl group, each containing at least 3 fluorine atoms.

As an anionic fluorine-containing surfactant preferably used in the present invention, those represented by the following Formula (FA') are cited.

Formula $$(FA')Rf—(D)_t—Y$$

wherein Rf represents a fluorine-containing alkyl group having 2–30 carbon atoms or an aryl group having a fluorine- containing alkyl group of 2–30 carbon atoms; D represents a divalent group having at least one of —O—, —COO—, —$CON(R_1)$— and —$SO_2N(R_1)$— bond and having 1 to 12 carbon atoms; $R_1$ represents an alkyl group having 1 to 5 carbon atoms; t represents 0, 1 or 2; Y represents —COOM—, —$SO_3M$, —$OSO_3M$ or —$P(=O)(OM)_2$; and M represents a hydrogen atom, an alkali metal or a cation such as a quaternary ammonium salt.

Rf preferably represents a fluorine-containing alkyl group having 3 to 10 carbon atoms, D preferably represents a divalent group containing an alkylene group having 1 to 5 carbon atoms and at least one of —O—, —COO—, —$CON(R_1)$— and —$SO_2N(R_1)$—, or a divalent group containing an arylene group and at least one of —O—, —COO—, —$CON(R_1)$— and —$SO_2N(R_1)$— in which $R_1$ represents an alkyl group having 1 to 5 carbon atoms, and Y preferably represents —COOM or —$SO_3M$ in which M represents an alkali metal, preferably sodium or potassium.

Next, practical examples of the compounds represented by Formula (FA) will be illustrated. However, the present invention is not limited thereto.

$C_7F_{15}COONH_4$ FA-1

$C_{10}F_{21}(CH_2)_{10}COOH$ FA-2

$C_8F_{17}SO_2N(C_3H_7)CH_2CH_2O(CH_2)_3SO_3Na$ FA-3

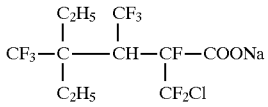
FA-4

$ClCF_2(CFCl)CF_2)_4COOH$ FA-5

$H(CF_2)_{10}COOH$ FA-6

$HOOC(CF_2CF(Cl))_4COOH$ FA-7

$Cl(CF_2CF(Cl))_3CF_2COOK$ FA-8

$C_5F_{11}CH=CH(CH_2)_3COONa$ FA-9

$C_4F_9CF(CF_3)(CH_2)_{10}COONa$ FA-10

$C_4F_9CON(CH_3)CH_2CH_2COOH$ FA-11

$Cl(CF_2)_6COONa$ FA-12

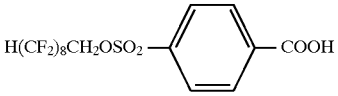
FA-13

$C_{10}F_{21}CH_2CH_2SO_2N(C_2H_5)CH_2COONa$ FA-14

$C_6F_{13}CON(C_2H_5)CH_2COONa$ FA-15

$C_8F_{17}SO_2N(C_3H_7)CH_2CH_2SO_3Na$ FA-16

$C_8F_{17}CON(C_2H_5)CH_2CH_2SO_3Na$ FA-17

$C_8F_{17}SO_2N(C_2H_5)CH_2COONa$ FA-18

$C_8F_{17}SO_2N(C_3H_7)CH_2COOK$ FA-19

$C_8F_{17}SO_2N(CH_3)(CH_2CH_2O)_4(CH_2)_4SO_3Na$ FA-20

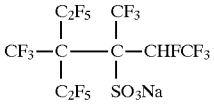
FA-21

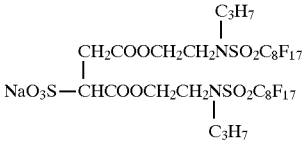
FA-22

-continued
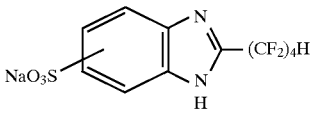
FA-23
wherein —$SO_3Na$ is a 5- or 6-positioned or mixture thereof
$H(CF_2)_6CH_2PO_3H_2$ FA-24
$H(CF_2)_8PO_3Na_2$ FA-25
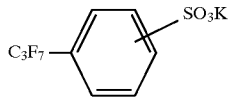
wherein —$SO_3K$ is a -o, -m or -p-positioned or mixture thereof
$C_8F_{17}SO_2N(CH_2)_6COOK$ FA-27
$\quad\quad\quad substituent, having 1 to 6 carbon atoms; p, r and s independently represent 0 through 6; and q represents 1 through 20.

As examples of $Y^-$, $I^-$, $Cl^-$, $Br^-$, $CH_3SO_3^-$ and $CH_3—C_6H_4—SO_3—$ are cited.

Hereunder, practical examples of the cationic fluorine-containing surfactants preferably used in the present invention will be exhibited. However, the present invention is not limited thereto.

FK-1

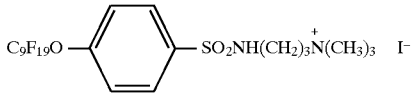

FK-2

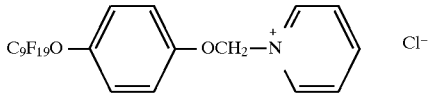

FK-3 $C_7F_{15}CONH(CH_2)_2N^+(CH_3)_3$ $Cl^-$

FK-4

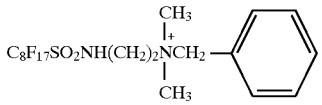

FK-5 $C_2F_5CONH(CH_2)_3N^+(CH_3)_3$ $I^-$

FK-6 $C_{12}F_{23}O(CH_2CH_2O)_5CH_2CH_2N^+(CH_3)_3$ $I^-$

FK-7

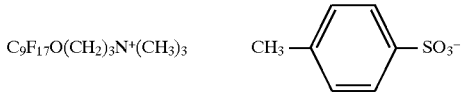

FK-8 $C_8F_{17}SO_2NH(CH_2)_3N^+(CH_3)_3$ $I^-$

FK-9 $C_8F_{17}SO_2NH(CH_2)_3N^+(CH_2CH_2OCH_3)_3$ $I^-$

FK-10

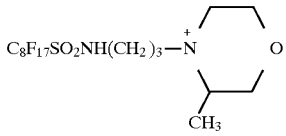

FK-11

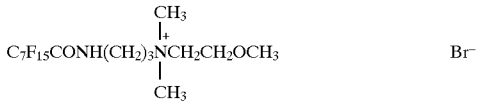

FK-12 $C_9F_{19}CONH(CH_2)_5N^+(CH_3)_3$ $I^-$

FK-13

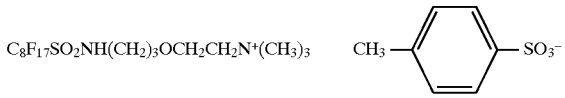

FK-14

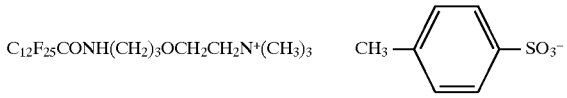

FK-15

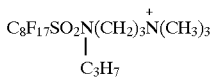

FK-16

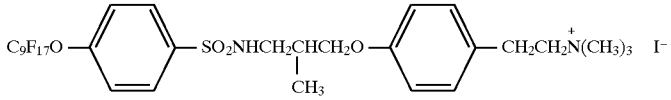

FK-17

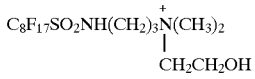

FK-18

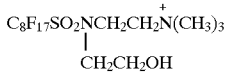

-continued $C_8F_{17}SO_2NH(CH_2)_3N^+(CH_3)_3$ 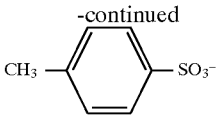 FK-19

$C_8F_{17}CH_2\underset{\underset{OH}{|}}{C}HCH_2\overset{+}{N}(CH_2CH_2OH)_2$ $\underset{\underset{CH_3}{|}}{}$ $Cl^-$ FK-20

$C_8F_{17}SO_2NH(CH_2)_3N^+(CH_3)_3$ $Br^-$ FK-21

The anionic fluorine-containing surfactants or the cationic fluorine-containing surfactants of the present invention can be synthesized by methods described in U.S. Pat. Nos. 2,559,751, 2,567,011, 2,732,398, 2,764,602, 2,806,866, 2,809,998, 2,915,376, 2,915,528, 2,918,501, 2,934,450, 2,937,098, 2,957,031, 3,472,894 and 3,555,089, British Patent Nos. 1,143,927 and 1,130,822, Japanese Patent Publication No. 37304/1970, Japanese Patent O.P.I. Nos. 9613/1972, 134614/1974, 117705/1975, 117727/1975, 121243/1975, 41182/1977 and 12392/1976, J. Chem, Soc., 1950, page 2789 and 1957, pp. 2574 and 2640, J. Amer. Chem. Soc., Volume 79, page 2549 (1957), J. Japan Oil Chemists Soc., Volume 12, page 653 and J. Org. Chem., Volume 30, page 3524 (1965).

Some of the above-mentioned fluorine-containing surfactants are commercially available as follows: Megafac F produced by DaiNippon Ink Chemical Industry Co, Ltd.; Fluorad FC produced by Minesota Mining and Manufacturing Company; Monflor produced by Imperial Chemical Industry; Zonyls produced by E. I. Du Pont Nemeras and Company; Licowet produced by Falbewereke Hexist.

The total amount of the anionic fluorine-containing surfactant and cationic fluorine-containing surfactant used in the invention is 0.1 to 1000 mg, preferably 0.5 to 300 mg and more preferably 1.0 to 150 mg per 1 $m^2$ of recording sheet. The anionic fluorine-containing surfactant and cationic fluorine-containing surfactant each may be used in two or more kinds, respectively. In addition to these surfactants, a nonionic or amphoteric fluorine-containing surfactant or a hydrocarbon type surfactant may be used in combination.

The addition amount ratio of the anionic fluorine-containing surfactant to the cationic fluorine-containing surfactant in the invention is preferably 1:10 to 10:1 by mole ratio, and more preferably 3:7 to 7:3 by mole ratio.

In the invention, the ink receiving layer of a recording sheet for ink-jet recording contains the anionic fluorine-containing surfactant and the cationic fluorine-containing surfactant, and further contains a binder for forming the layer. The binder includes a natural polymer and a synthetic polymer. The binder used in the invention is preferably gelatin.

As gelatin, any gelatin made from animal collagen can be used, but gelatin made from pig skin, cow skin or cow bone collagen is preferable. The kind of gelatin is not specifically limited, but lime-processed gelatin, acid processed gelatin or gelatin derivatives (for example, gelatin derivatives disclosed in Japanese Patent Publication Nos. 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and British Patent Nos. 861,414 and 103,189) can be used singly or in combination.

In one of the preferable embodiments in the invention, acid processed gelatin is used in view of ink absorption, and gelatin in which the amino group is inactivated is used in view of ink absorption or glossiness.

The acid processed gelatin preferably used in the invention is prepared by deliming collagen and then processing it with an acid such as hydrochloric acid.

The amino group inactivating gelatin preferably used in the invention is gelatin in which 50% or more, preferably 80% or more and more preferably 90%, of the amino group, are inactivated. The above gelatin, which is prepared according to a conventional acetylation method, includes acetylated gelatin, phthaloylated gelatin, malenoylated gelatin, benzoylated gelatin, succinoylated gelatin, methyl urea gelatin, phenylcarbamoylated gelatin, and carboxy modified gelatin.

The jelly strength of gelatin used in the invention is preferably not less than 150 kg, and more preferably 200 to 300 kg (according to the PAGI method). The jelly strength of gelatin is measured with a bloom gelometer.

In the invention, the gelatin content of the ink receiving layer is preferably 3 to 50 $g/m^2$, and more preferably 5 to 30 $g/m^2$. If the gelatin content is less than 3 $g/m^2$, ink reception is deteriorated, resulting in ink release from the ink received portions after printing, and if the gelatin content exceeds 50 $g/m^2$, ink reception is improved but cracking or curling occurs.

The thickness of the ink receiving layer in the invention is preferably 1 to 50 $\mu$m, and more preferably 2 to 30 $\mu$m.

In order to improve ink reception or dot reproduction, the following water-soluble polymer can be used. The water-soluble polymer includes polyvinyl alcohol, polyvinyl pyrrolidone, polyvinyl pyridinium halide, modified polyvinyl alcohol such as polyvinyl formal or their derivatives (see Japanese Patent O.P.I. Publication Nos. 145879/1985, 220750/1985, 143177/1986, 235182/1986, 235183/1986, 237681/1986 and 261089/1986), an acryl group-containing polymer such as polyacrylamide, polydimethylacrylamide, polydimethylaminoacrylate, polysodiumacrylate, acrylic acid-meth acrylic acid copolymer salt, polysodium-methacrylate or acrylic acid-vinyl alcohol copolymer (disclosed in Japanese Patent O.P.I. Publication Nos. 168651/1985 and 9988/1987), a natural polymer or its derivatives such as starch, oxidation starch, carboxylated starch, dialdehyde starch, cationated starch, dextrin, sodium alginate, gum arabic, casein, pullulan, dextrane, methylcellulose, ethylcellulose, carboxymethylcellulose or hydroxypropylcellulose (Japanese Patent O.P.I. Publication Nos. 174382/1974, 262685/1985, 143177/1986, 181679/1986, 193879/1986 and 287782/1986), a synthetic polymer such as polyethylene glycol, polypropylene glycol, polyvinyl ether, polyglycerin, maleic acid-alkylvinylether copolymer, maleic acid-N-vinylpyrrole copolymer, styrene-maleic anhydride copolymer or polyethylene imine (disclosed in Japanese Patent O.P.I. Publication Nos.32787/1986, 237680/1986 and 277483/1986). Of these, the preferable are polyethylene glycol, polyvinyl alcohol and polyvinyl pyrrolidone, and the more preferable are polyvinyl alcohol and polyvinyl pyrrolidone. The average molecular weight of these polymers is preferably not less than 10,000, and more preferably not less than 100,000 in view of tackiness of the polymer surface.

The water soluble polymer can be used singly or in combination, but the invention is more effected by the combination use with the above described gelatin. The water soluble polymer content of the ink receiving layer is 3 to 50 g/m$^2$, and preferably 5 to 30 g/m$^2$.

When the water soluble polymer is used with gelatin in the invention, the addition amount ratio (by weight %) of the water soluble polymer to gelatin depends on the kinds of the polymer, but is preferably 10 to 70%, more preferably 40 to 60% by weight in order to improve ink reception and/or dot image reproduction.

The ink receiving layer in the invention preferably further contains basic latexes disclosed in Japanese Patent Application No. 7-54286/1995, and especially preferably exemplified compounds I-1 through I-12 on pages 16 to 18, in that excellent print can be obtained independent of circumstances.

The ink receiving layer in the invention preferably contains water soluble polymers disclosed in Japanese Patent Application No. 7-64334/1995 in order to shorten the ink drying time.

In the invention, the ink receiving layer can be hardened with a hardener in order to improve water resistance or dot reproduction. The example of the hardener includes aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed U.S. Pat. No. 3,288,775, divinylsulfone, reactive olefin-containing compounds disclosed U.S. Pat. No. 3,635,718, N-methylol compounds disclosed U.S. Pat. No. 2,732,316, isocyanates disclosed U.S. Pat. No. 3,103,437, aziridine compounds disclosed U.S. Pat. Nos. 3,017,280 and 2,983,611, carbodiimides disclosed U.S. Pat. No. 3,100,704, epoxy compounds disclosed U.S. Pat. No. 3,091,537, a halogen-carboxyaldehyde such as mucochloric acid, a dioxane derivative such as dihydroxy dioxane, and inorganic hardeners such as chromium alum, potash alum and zirconium sulfate. These hardeners can be used singly or in combination. The addition amount of hardener is preferably 0.01 to 10 g, and more preferably 0.1 to 5 g based on 100 g of a binder contained in the ink receiving layer.

The ink receiving layer may contain a matting agent in an amount of 0.005 to 0.1 g/m$^2$ in order to prevent adhesion defect such as blocking.

The matting agent can be defined as discontinuously dispersed particles such as inorganic or organic materials capable of being dispersed in a hydrophilic organic colloid. The inorganic matting agent includes oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of an iodine atom), and glass. Besides these substances are used inorganic matting agents which are disclosed in West German Patent No. 2,529,321, British Patent Nos. 760 775 and 1,260,772, U.S. Pat. Nos. 1,201,905, 2,192,241, 3,053,662, 3,062,649, 3,257,296, 3,322.555, 3,353,958, 3,370,951, 3,411,907, 3,437,484, 3,.523,022, 3,615,554, 3,635,714, 3,769,020, 4,021,245 and 4,029,504.

The organic matting agent includes starch, cellulose ester such as cellulose acetate propionate, cellulose ether such as ethyl cellulose and a synthetic resin. The synthetic resin is a water insoluble or sparingly soluble polymer which includes a polymer of an alkyl(meth)acrylate, an alkoxyalkyl-(meth) acrylate, a glycidyl(meth)acrylate, a (meth)acrylamide, a vinyl ester such as vinyl acetate, acrylonitrile, an olefin such as ethylene, or styrene and a copolymer of the above described monomer with other monomers such as acrylic acid, methacrylic acid, α,β-unsaturated dicarboxylic acid, hydroxyalkyl(meth)acrylate, sulfoalkyl(meth)acrylate and styrene sulfonic acid. Further, a benzoguanamin-formaldehyde resin, an epoxy resin, nylon, polycarbonates, phenol resins, polyvinyl carbazol or polyvinylidene chloride can be used. Besides the above are used inorganic matting agents which are disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,.516,832, 3,539,344,554, 3,591,379, 3,754,924 and 3,767,448, Japanese Patent O.P.I. Publication Nos. 49-106821/1974 and 57-14835/1982.

Of these are preferable polymethylmethacrylate, a benzoguanamine-formaldehyde polycondensate (a benzoguanamine resin as represented by the following formula, for example, Eposter produced by Nihon Shokubai Kagakukogyo Co., Ltd., or (Chemical Substance Registry No. 7–31 compound),

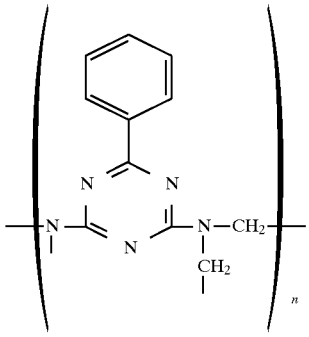

polyolefins (for example, Frobeads LE-1080, CL-2080, HE-5023: produced by Seitetsu Kagaku Co., Ltd., or Chemipar V-100 produced by Mitsuisekiyu Kagakukogyo Co., Ltd.), polystyrene beads (produced by Moritex Co., Ltd.), nylon beads (produced by Moritex Co., Ltd.), AS resin beads (produced by Moritex Co., Ltd.), epoxy resin beads (produced by Moritex Co., Ltd.) or polycarbonate resin beads (produced by Moritex Co., Ltd.).

These matting agents may be used in combination.

The ink receiving layer in the invention may further contain, in addition to the above surfactant of the invention, the binder and the hardener, various conventional additives such as inorganic pigment, colorants, colored pigment, a fixing agent for ink dyes, a UV absorber, an anti-oxidant, a dispersing agent, an anti-foaming agent, a leveling agent, an antiseptic agent, a brightening agent, a viscosity stabilizing agent and a pH adjusting agent.

As a coating method of an ink receiving layer coating solution, any conventional coating method (for example, a curtain method, an extrusion method, an air-knife method, a roll coating method and a rod bar coating method) can be used.

The ink receiving layer may be single layered or multi-layered. The example of the multi-layered includes those disclosed in Japanese Patent O.P.I. Publication Nos. 57-89954/1982, 60-224578/1985 and 61-12388/1988. Further, an ink penetrating layer may be provided on the ink receiving layer.

The ink receiving layer is provided on at least one surface of the support, and may be provided on both surfaces of the support in order to minimize curling.

As a support used in the invention, a transparent or opaque support can be optionally used according to its use. A conventional support can be used as the transparent support, which includes a film or plate of polyester resins, cellulose acetate resins, acryl resins, polycarbonate resins, polyvinyl chloride resins, polyimide resins, cellophane or celluloid and a glass plate.

The thickness of the transparent support is preferably 10 to 200 $\mu$m. As the opaque support, any conventional one such as paper, coat paper, synthetic paper, resin-covered paper, pigment-containing opaque film or foaming film can be used in the invention, but synthetic paper, a resin-covered paper or various films are preferable in view of glossiness or smoothness, and resin-covered paper or polyester film is preferable in view of touchiness or luxuriousness.

The base paper constituting the resin-covered paper used in the invention is not specifically limited, and any conventional paper can be used, but a smooth paper used as a conventional photographic support is preferable. As pulp constituting the base paper, natural pulp, reproduction pulp or synthetic pulp is used singly or in admixture. These base papers may contain additives such as a sizing agent, a reinforcing agent, a filler, an anti-static agent, a fluorescent brightening agent or a dye which is usually used in paper manufacture. A surface sizing agent, a surface reinforcing agent, a fluorescent brightening agent, an antistatic agent and an anchoring agent may be coated on the surface of the material.

The thickness of the base paper is not specifically limited, but is preferably 10 to 200 $\mu$m. A base paper having a smooth surface is preferable, which is obtained by applying pressure to or calendering, paper, during or after papering. The weight of the base paper is preferably 30 to 250 g/m$^2$ As a resin for a resin-covered paper, a polyolefin resin or a resin capable of being hardened with an electron beam can be used. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigment such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox 1010 or Irganox 1076, blue pigment or dyes such as cobalt blue, ultramarine, or phthalocyanine blue, magenta pigment or dyes such as cobalt violet, fast violet or manganese violet, a brightening agent and a UV absorber. These additives can be suitably used in combination.

The resin-covered paper, which is the support preferably used in the invention, is manufactured by a so-called extrusion method casting a thermally fused resin (for example, fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, and glossy surface is preferable. The back side of a support is not necessarily covered with a resin, but is preferably covered with a resin in view of prevention of curling. The back surface of a support is ordinarily non-glossy, but the back surface or both surfaces of the support are optionally subjected to activation treatment such as corona discharge treatment or flame treatment. The thickness of a covered resin is not specifically limited, but is ordinarily 5 to 50 $\mu$m.

The water based ink herein referred to is a recording liquid comprising the following colorants, solvents and other additives. The colorant includes a direct dye, an acid dye, a basic die, a reactive dye and food dyes.

The solvent for water based ink includes alkyl alcohols having 1 to 4 carbon atoms such as methyl alcohol, ethyl alcohol, isopropyl alcohol, butyl alcohol, sec-butyl alcohol, tert-butyl alcohol and iso-butyl alcohol, amides such as dimethylformamide and dimethylacetoamide, ketones or ketonealcohols such as acetone and diacetone alcohol, ethers such as tetrahydrofurane and dioxane, polyalkylene glycols such as polyethylene glycol and polypropylene glycol, alkylene glycols having 2 to 6 carbon atoms such as ethylene glycol, propylene, butylene glycol, triethylene glycol, 1,3, 6-hexane triol, hexylene glycol, thiodiglycol and diethylene glycol, polyhydric alcohol lower alkyl ethers such as glycerin, .ethylene glycol methylether, diethylene glycol methyl(or ethyl)ether and triethylene glycol monomethylether, pyrrolidinones such as 2H-pyrrolidinone, and pyrrolidones such as 1-methyl-2-pyrrolidone and 2-pyrrolidone. Of these water soluble solvents, a polyhydric alcohol such as diethylene polyhydric alcohol lower alkyl ethers such as triethylene glycol monomethylether and triethylene glycol monoethylether, and pyrrolidones are preferable.

In the invention, the solvent for ink is preferably a mixture solvent of water and the above described organic solvent in view of prevention of ink head nozzle clogging. The mixture ratio of water to the organic solvent is preferably 1:9 to 9:1 by weight, and more preferably 4:6 to 9:1 by weight.

The additives include a pH adjusting agent, a metal chelating agent, an anti-fungal, a viscosity adjusting agent, a surface tension adjusting agent, a wetting agent, a surfactant and an anti-rust agent.

EXAMPLES

The invention will be detailed in the following examples, but the invention is not limited thereto.

Example 1

The following ink receiving layer coating solution was coated on RC paper available on the market by means of a bar coating method and dried to give a dry thickness of 8 g/m$^2$. Thus, a recording sheet sample for ink jet recording was obtained. Next, yellow (Y), magenta (M) and cyan (C) color images were printed on the above obtained sample, employing an ink jet printer, Design Jet 650C (produced by Hulet Packerd Co., Ltd.). The resulting sample was evaluated for dot diameter, optical density and unevenness at magenta color image portions.

<Ink receiving layer aqueous coating solution>

| | | |
|---|---|---|
| Lime-processed gelatin (Bloom strength; 250 g) | | 100 parts by weight |
| Surfactants (shown in Table 1) | | shown in Table 1 |
| *Solid component concentration of the coating solution was 8% by weight. The composition of each ink was as follows: | | |
| Y: | Direct yellow 50 (CI. 29025) | 6 parts by weight |
| | Diethylene glycol | 47 parts by weight |
| | Water | 47 parts by weight |
| M: | Xylene red B (C1. 45100) | 6 parts by weight |
| | Diethylene glycol | 47 parts by weight |
| | Water | 47 parts by weight |
| C: | Light green SF Yellowish | 6 parts by weight |
| | Diethylene glycol | 47 parts by weight |
| | Water | 47 parts by weight |

Results of evaluation will be shown as follows:

<Evaluation of image unevenness>

A: Excellent, (without problem).

B: Good.

C: Some patchiness observed.

D: Patchiness prevalent too much to be practically used.

TABLE 1

| Sample No. | Anionic fluorine-containing surfactant (mg/m$^2$) | Cationic fluorine-containing surfactant (mg/m$^2$) | Dot diameter ($\mu$m) | Density of solid image | Image unevenness | Remarks |
|---|---|---|---|---|---|---|
| 1-1 | None | None | 100 | 1.01 | D | Comp. |
| 1-2 | FA-2 (4) | None | 102 | 1.02 | C | Comp. |
| 1-3 | None | FK-4 (4) | 103 | 1.04 | C | Comp. |
| 1-4 | FA-2 (4) | FK-4 (4) | 102 | 1.21 | B | Inv. |
| 1-5 | FA-16 (3) | FK-5 (3) | 103 | 1.22 | B | Inv. |
| 1-6 | FA-18 (4) | FK-8 (4) | 100 | 1.23 | B | Inv. |
| 1-7 | FA-19 (4) | FK-21 (4) | 104 | 1.21 | A | Inv. |
| 1-8 | FA-31 (4) | FK-20 (4) | 101 | 1.21 | B | Inv. |
| 1-9 | FA-2 (4) | FK-4 (4) | 101 | 1.18 | B | Inv. |
| 1-10 | FA-2 (5.6) | FK-4 (4) | 101 | 1.20 | B | Inv. |
| 1-11 | FA-2 (2.4) | FK-4 (4) | 102 | 1.20 | B | Inv. |
| 1-12 | FA-2 (0.4) | FK-4 (4.0) | 101 | 1.17 | B | Inv. |

Comp.: Comparative
Inv.: Invention

From the above Table 1, it can be seen that the recording sheet for ink jet recording of the present invention could obtain favorable results in all evaluation items. Therefore, it is evident that the recording sheet of the present invention can produce images with high quality.

Example 2

Recording sheets for ink-jet recording were prepared in the same manner as in Sample 1–6 prepared in Example 1, except that the amount of the surfactants was changed as shown in the following Table 2. The resulting sheets were evaluated in the same manner as in Example 1, except that dot diameter, optical density and image unevenness at cyan color image portions were evaluated. In addition, glossiness of the print image was evaluated visually.

<Evaluation of glossiness>

A: Excellent

B: Glossiness of the printed portions is slightly degraded.

C: Glossiness of the printed portions is totally absent.

Table 2 shows the results.

TABLE 2

| Sample No. | Anionic surfactant (mg/m$^2$) | Cationic surfactant (mg/m$^2$) | Optical density | Image unevenness | Glossiness |
|---|---|---|---|---|---|
| 2-1 | 500 | 500 | 1.22 | B | C |
| 2-2 | 300 | 300 | 1.23 | A | C |
| 2-3 | 150 | 150 | 1.24 | A | B |
| 2-4 | 100 | 100 | 1.21 | A | B |
| 2-5 | 75 | 75 | 1.21 | A | A |
| 2-6 | 25 | 25 | 1.20 | A | A |
| 2-7 | 5 | 5 | 1.19 | A | A |
| 2-8 | 0.5 | 0.5 | 1.17 | A | A |
| 2-9 | 0.25 | 0.25 | 1.17 | B | A |
| 2-10 | 0.05 | 0.05 | 1.15 | C | A |

From the above-mentioned Table 2, it can be understood that the recording sheet for ink-jet recording of the present invention has no unevenness at an image portion and in addition, has excellent glossiness.

Example 3

Recording sheets for ink jet recording were prepared in the same manner as in Sample 1–6 of Example 1, except that water-soluble polymers described in Table 3 were further added. They were evaluated for ink absorption in addition to the same evaluation as described in Example 1.

<Evaluation on ink absorptivity>

Commercially available wood free paper was brought into contact with the magenta solid image at 1 kg/m$^2$ pressure, and then, the transfer degree of the ink onto the wood free paper was evaluated.

A : When the contact was carried out 30 seconds after printing, no ink transfer was observed.

B : When the contact was carried out 30 seconds after printing, slight ink transfer was observed, but when the contact was carried out one minute after printing, no ink transfer was observed.

C : When the contact was carried out one minute after printing, slight ink transfer was observed, but no practical problem.

TABLE 3

| Sample No. | Water-soluble polymer, addition ratio based on gelatin (wt %) | Optical density of solid image | Image unevenness | Ink absorptivity |
|---|---|---|---|---|
| 3-1 | PEG 6000[1)] (50%) (Nippon Yushi) | 1.34 | B | C |
| 3-2 | Cerazol 100A[2)] (50%) (Meisei Kagaku) | 1.44 | B | A |
| 3-3 | PVA GL-05[3)] (50%) (Nihon Gosei Kagaku Kogyo) | 1.32 | A | B |
| 3-4 | PVP K-90[4)] (5%) (BASF) | 1.25 | B | C |
| 3-5 | PVP K-90 (10%) | 1.28 | B | B |
| 3-6 | PVP K-90 (30%) | 1.30 | B | A |
| 3-7 | PVP K-90 (40%) | 1.33 | A | A |
| 3-8 | PVP K-90 (50%) | 1.36 | A | A |
| 3-9 | PVP K-90 (60%) | 1.37 | A | A |
| 3-10 | PVP K-90 (70%) | 1.33 | B | A |
| 3-11 | PVP K-90 (80%) | 1.34 | B | B |

*[1)]average molecular weight: 6,000
[2)]average molecular weight: 150,000
[3)]average molecular weight: 22,000
[4)]average molecular weight: 360,0000

As is apparent from the results shown in Table 3, when the water-soluble polymer is added to the ink-receiving layer, both the optical density of the print portion and the absorptivity of the ink are improved.

Example 4

A sample was prepared with the same coating solution composition as Example 1 except that a commercially available polyethylene terephthalate film (the layer thickness was 100 μm) in place of the RC paper used in Example 1, and was evaluated in the same manner as in Example 1. The results were almost the same as Example 1.

Example 5

Samples 5-1 and 5-2 were prepared in the same manner as in Sample 3-6 of Example 3 except that cationic denatured PVP (GAFQUAT HS-100 produced by ISP Inc.) and polyallyl amine hydrochloride (PAA-HCI produced by Nittoh-bo Co. Ltd.) were added in an amount of 10 wt % based on gelatin, respectively, and were evaluated in the same manner as in Example 3. Results showed that Samples 5-1 and 5-2 had the same optical density and uneven image as those of Sample 3-6. However, the ink absorption of Samples 5-1 and 5-2 were half of that of Sample 3-6. Therefore, noticeable improvement was observed.

Example 6

The 7 weight % (as solid content) aqueous solutions containing the following layer compositions were coated on RC paper according to a bar coating method to obtain a recording sheet for ink jet recording.

| | |
|---|---|
| First Layer (a layer closest to the polyethylene paper) | |
| Lime-processed gelatin | 1.2 g/m$^2$ |
| PVP-K90 | 0.8 g/m$^2$ |
| Second Layer (an intermediate layer) | |
| Gelatin (as shown in Table 4) | 3.3 g/m$^2$ |
| PVP-K90 | 3.7 g/m$^2$ |

-continued

| | |
|---|---|
| Third Layer (a layer furthest from the polyethylene paper) | |
| Gelatin (as shown in Table 4) | 0.7 g/m$^2$ |
| PVP-K90 | 0.6 g/m$^2$ |
| Sodium di-2-ethylhexylsulfosuccinate | 16 mg/m$^2$ |
| Exemplified Compound FA-19 | 5 mg/m$^2$ |
| Exemplified Compound FA-21 | 5 mg/m$^2$ |
| Matting agent (Polymethylmethacrylate average grain size: 10 μm) | 40 mg/m$^2$ |

An image was printed using the above obtained sheet and an ink-jet printer (MJ-700V2C produced by Epson Co., Ltd.).

The resulting sheet was evaluated for image unevenness and ink absorption in the same manner as in Example 3. Further, glossiness of non-image portions at 60° was measured by a gloss meter VG-ID (produced by Nihon Densyoku kogyo Co., Ltd.).

The evaluation criteria of the glossiness were as follows:

A: 80 or more; excellent glossiness
B: Less than 80 to 70; good glossiness
C: Less than 70 to 50; fair glossiness
D: Less than 50; poor glossiness The results are shown in Table 4.

TABLE 4

| Sample No. | Gelatin in Second Layer | Gelatin in Third Layer | Image unevenness | Ink absorptivity | Glossiness at non-image portions |
|---|---|---|---|---|---|
| 6-1 | lime-processed gelatin | lime-processed gelatin | B | B | B |
| 6-2 | *PC gelatin | lime-processed gelatin | A | B | B |
| 6-3 | lime-processed gelatin | PC gelatin | B | A | A |
| 6-4 | PC gelatin | PC gelatin | A | A | A |
| 6-5 | acid-processed gelatin | lime-processed gelatin | B | A | B |

*PC gelatin:phenylcarbamoylated gelatin a phenylcarbamoylation degeree of 98% or more As is apparent from Table 4, use of acid-processed gelatin provides more excellent ink absorptivity, and the use of amino group inactivated gelatin provides more excellent glossiness of non-image portions as well as provides more excellent image quality and ink absorptivity, resulting in improvement of print quality.

What is claimed is:

1. A method for ink-jet recording, comprising the steps of:

providing an ink-jet printer; providing an ink-jet recording sheet for said ink-jet printer; forming said recording sheet of a support and an ink receiving layer comprising a binder, an anionic fluorine-containing surfactant, and a cationic fluorine-containing surfactant, provided on said support; and jetting onto said recording sheet a water-based ink.

2. The method of claim 1, wherein the step of forming includes the anionic fluorine-containing surfactant is a compound represented by Formula (FA) and the cationic fluorine-containing surfactant is a compound represented by Formula (FK):

Formula (FA)

$$(Cf)—(Y)_n$$

wherein Cf represents a n-valent group having at least 3 fluorine atoms and at least 2 carbon atoms; Y is selected from the group consisting of —COOM, —$SO_3M$, —$OSO_3M$ and —P(=O)$(OM)_2$ in which M is selected from the group consisting of a hydrogen atom, an alkali metal and a quaternary ammonium group; and n represents 1 or 2, Formula (FK)

$$(Rf')—L—X^+Z^-$$

wherein Rf' represents a fluorine-containing hydrocarbon group having 1–20 carbon atoms; L is selected from the group consisting of a chemical bond, —$SO_2N(R^1)(CH_2)_p$—, —$CON(R^1)(CH_2)_p$—, —$OASO_2N(R^1)(CH_2)_p$—, —$OACON(R^1)(CH_2)_p$—, —$OAO(CH_2)_p$—, —$OA(CH_2)_p$—, —$O(CH_2CH_2O)_q(CH_2)_p$—, —$O(CH_2)_p$—, —$N(R^1)(CH_2)_p$—, —$SO_2N(R^1)(CH_2)_pO(CH_2)_r$—, —$CON(R^1)(CH_2)_pO(CH_2)_r$—, —$OASO_2N(R^1)(CHR^1)_pOA$— and —$(CH_2)_p(CHOH)s(CH_2)_r$—, in which A represents an alkylene group or an arylene group, $R^1$ and $R^2$ independently represent a hydrogen atom or an alkyl group having 1 to 6 carbon atoms, p, r and s independently represent an integer of 0 to 6 and q represents an integer of 1 to 20; $X^+$ represents a cation; and $Z^-$ represents an anion.

3. The method of claim 1 wherein the step of forming includes using a gelatin as said binder.

4. The method of claim 3, wherein the step of forming includes using an acid-based gelatin or an amino group-inactivated gelatin.

5. The method of claim 3, wherein the step of forming includes the ink receiving layer having a gelatin content of 3 to 50 g/$m^2$.

6. The method of claim 1 wherein the step of forming includes using a gelatin as said binder and a water-soluble polymer.

7. The method of claim 6, wherein the step of forming includes using a water-soluble polymer comprising polyvinyl pyrrolidones or polyvinyl alcohols.

8. The method of claim 6, wherein the step of forming includes using said water-soluble polymer in said binder in an amount which is 10–70 weight % of an amount of gelatin in said binder.

9. The method of claim 1 wherein the step of forming includes providing a polyester film or a resin-covered paper as said support.

10. The method of claim 1 wherein the step of forming includes the anionic fluorine-containing surfactant and the cationic fluorine-containing surfactant is present in a mole ratio of 1:10 to 10:1 in the ink receiving layer.

11. The method of claim 1 wherein the step of forming includes the total content of the anionic fluorine-containing surfactant and the cationic fluorine-containing surfactant is 0.5 to 300 mg/$m^2$ of recording sheet.

* * * * *